United States Patent [19]

Burger

[11] Patent Number: 4,645,281

[45] Date of Patent: Feb. 24, 1987

[54] BNC SECURITY SHIELD

[75] Inventor: Donald A. Burger, Big Flats, N.Y.

[73] Assignee: LRC Electronics, Inc., Horseheads, N.Y.

[21] Appl. No.: 698,127

[22] Filed: Feb. 4, 1985

[51] Int. Cl.[4] ..... H01R 13/44

[52] U.S. Cl. ..... 339/37; 339/89 C; 339/82

[58] Field of Search ..... 339/36, 37, 39, 82–87, 339/89 R, 89 C, 91 R

[56] References Cited

U.S. PATENT DOCUMENTS

| | | | |
|---|---|---|---|
| 3,292,117 | 12/1966 | Bryant et al. | 339/97 |
| 3,439,294 | 4/1969 | Flanagan et al. | 333/33 |
| 3,573,702 | 4/1971 | O'Keefe | 339/37 |
| 3,573,708 | 4/1971 | Yarrick et al. | 339/18 |
| 3,861,770 | 1/1975 | Horak | 339/37 |
| 3,953,097 | 4/1976 | Graham | 339/37 |
| 3,970,969 | 7/1976 | Sirel et al. | 333/97 R |
| 3,982,803 | 9/1976 | Bennett | 339/37 |
| 4,053,195 | 10/1977 | Laverick et al. | 339/37 |
| 4,125,308 | 11/1978 | Schilling | 339/84 M |
| 4,168,921 | 9/1979 | Blanchard | 339/37 |
| 4,219,693 | 8/1980 | French | 339/82 |
| 4,428,632 | 1/1984 | Rich | 339/17 C |
| 4,440,464 | 4/1984 | Spinner | 339/89 C |

*Primary Examiner*—Gil Weidenfeld
*Assistant Examiner*—Paula A. Austin
*Attorney, Agent, or Firm*—Weingarten, Schurgin, Gagnebin & Hayes

[57] ABSTRACT

A freely rotating connector security shield for use with BNC or other connectors to prevent unauthorized access to the connector. The connectors appropriate for use with the security shield are secured by rotation about the connector axis to mate with the corresponding connector. According to the present invention, such axial connector rotation is prevented by surrounding the connector with a normally freely rotating cylindrical shield. Removal or insertion of the shielded connector from the mating connector requires the use of a corresponding installation tool. The connector is engaged through apertures in the shield which permit radial compressive forces by the installation tool to be applied across the connector. The connector thus held captive can now be connected to and removed from the corresponding mating connector.

9 Claims, 3 Drawing Figures

BNC SECURITY SHIELD

FIELD OF THE INVENTION

The present invention relates to connector assemblies, in particular, connector assemblies preventing unauthorized access having rotatably secured coaxial cable connectors therein.

BACKGROUND OF THE INVENTION

The unauthorized use of signals from circuits serviced by coaxial cables has traditionally been a problem for various industries, most significantly the CATV industry. It is therefore desirous to prevent the unauthorized equipment connection to or removal of access-inhibiting devices, such as dummy connectors, in a manner which cannot be easily overcome to gain access to that circuit. Previous attempts to limit circuit access have included protective connector coverings requiring the use of a mating installation tool inserted between the outer protective cover and the active connector portion. When the connector is used in harsh environments, the space between the two elements may accumulate dirt, making tool insertion difficult. Furthermore if the insertion tools must be placed over the coaxial cable or extend for any distance behind the connector, the connector assembly may not be practical in tight space installations. Therefore, it becomes important to provide a tamper-resistant connector which provides the durability and ease of use in all environments and equipment installations.

SUMMARY OF THE INVENTION

The present invention comprises a security shield applied over a BNC-style connector. The security shield contains an integral retaining spring which prevents removal of the shield after it is applied to the BNC connector, but allows free axial rotation over the connector. The security shield is applied by retracting the retaining spring with an insertion tool. Upon insertion in the security shield, the retaining springs lock with groove or recessed channel of the BNC connector, at which time the insertion tool is expelled from the security shield and no longer required. A connector installation tool is used to connect or disconnect the protected connector from a mating connector. The installation tool comprises a plier-like tool which grasps the connector by small-diameter protrusions extending inwardly and in opposition in the separation between the jaws. The jaws are expanded to accommodate the diameter of the security shield, and the inward-facing protrusions extend through the apertures in the security shield to grasp the BNC connector through a resilient spacer located within the security shield.

The connector having the security shield according to the present invention provides connection security to desired circuits, and can be easily operated by authorized personnel having the corresponding installation tool.

BRIEF DESCRIPTION OF THE DRAWING

These and further features according to the present invention will be better understood by reading the following detailed description, together with the drawing, wherein.

DETAILED DESCRIPTION OF THE DRAWING

Figure 1:
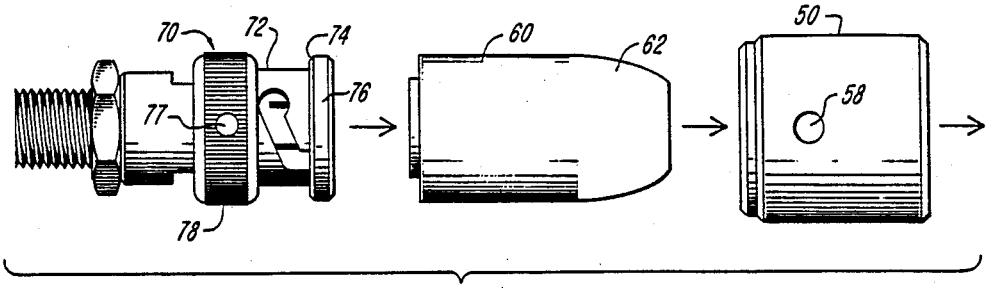
FIG. 1 shows the security shield and BNC connector before assembly.

The elements of FIG. 1 depict the security connector before assembly. The security connector, including a security shield 50, a BNC connector 70, is assembled with the aid of an insertion tool 60 having a curved surface 62 which is used to expand the retention spring 54 of FIG. 2. The connector 70 mates with the insertion tool 60, which are together passed through the central aperture of the security shield 50. The connector 70 has a recess 72 which receives the retaining spring 54, formed by the sharp lip 74 preventing disengagement of the security shield 50 from the connector 70. The retention spring 54 closes to grip the connector 70 in the recess 72. The insertion tool 60 is no longer needed, and may be discarded or stored for use in subsequent assemblies.

Figure 2:
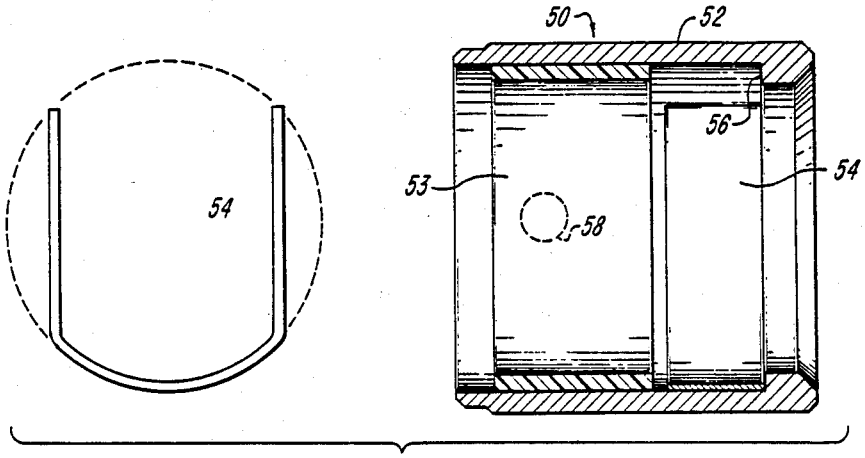
FIG. 2 shows the security shield in cross-section and retaining spring.

The security shield is shown in cross-section in FIG. 2, wherein the security shield 50 comprises a cylindrical sleeve 52 having a inwardly raised lip 56 which contains the front surface 76 of the connector 70. The retention spring 54 comprises a single U-shaped spring biased to seat within the recess 72 of the connector 70 when assembled. As described above the security shield 50 shown in FIG. 1 further includes a plurality of apertures 58 disposed radially about the connector 70 in the proximity 77 of a connector gripping surface 78. The apertures 58 are protected by a sleeve 53 comprising a resilient material, such as plastic, or other suitable material to allow the sleeve 52 to rotate freely over the connector 70. The sleeve 53 serves as a spacer. Moreover the thickness of the sleeve is selected to exclude instruments used to breach the security shield and as a protection device to keep out dirt particles from the connector.

Figure 3:
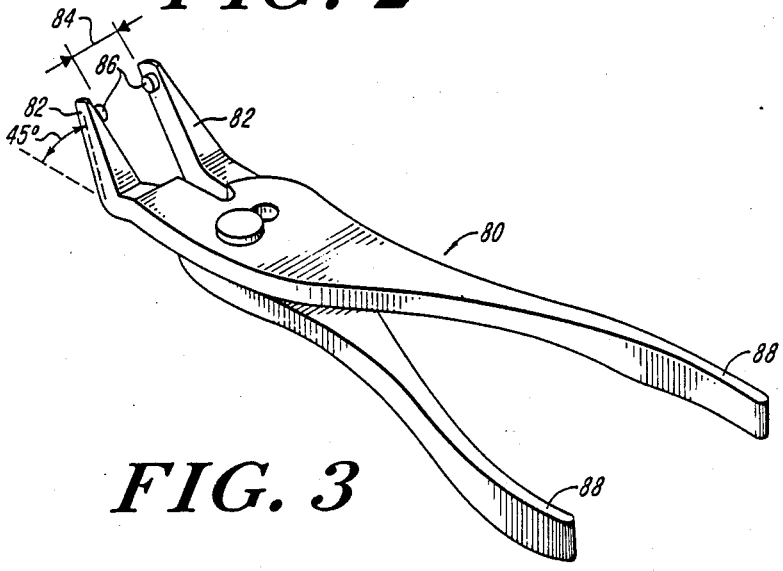
FIG. 3 shows the installation tool according to one embodiment of the present invention.

An installation tool 80 is shown in FIG. 3, wherein the jaws 82 have a spacing 84 which is slightly greater than that corresponding to the diameter of the security shield 50. The jaws 82 include pins or protrusions 86 positioned inwardly and in opposition, having a diameter which is less than the apertures 58. When the tool 80 is placed about the assembled security connector such that the protrusions 86 enter the apertures 58, compression on the tool handles 88 will compress the protrusions 86, causing the sleeve 53 to grip the surface 78 of the connector 70 in the vicinity 77, supplying sufficient friction to allow useful torque in rotating the connector to secure or remove such connector from a mating connector (not shown), and further allowing the application of axial forces as well. The installation tool 80 is further designed to operate in limited spaces, wherein the jaws 82 are elevated from the plane of the handles 88 by an angle, 45 degrees in the present embodiment. When assembled and installed, the completed security connector prevents unauthorized access, and further restrains access from axially inserted tools by close spacing of the shield 53 to the diameter of the gripping surface 78.

Other embodiments and substitution of elements made by one skilled in the art are considered within the scope of the present invention, which is not to be limited except by the claims which follow.

What is claimed is:

1. A security device for use with a connector having at least one recess requiring rotation for connection and disconnection, comprising:

a security shield having a shape to substantially surround said connector and adapted to receive said connector therein, said shield having at least one radially disposed aperture therein; and shield locking means to prevent removal of said shield from said connector after installation, including a spring biased toward said recess when said connector is received by said shield to provide retention thereof;

wherein said aperture is disposed to permit actuation of said connector.

2. The security device of claim 1, wherein said connector is a BNC connector.

3. The security device of claim 1, wherein said security shield has two apertures radially disposed in opposition.

4. The security device of claim 1, further including a spacer interposed between said connector and said security shield.

5. The security device of claim 4, wherein said spacer comprises a resilient spacer.

6. The security device of claim 5, wherein said spacer is located adjacent to said aperture and is deformable inwardly from said aperture toward said connector when a gripping force is imparted thereto through said aperture to as to transmit said force to said connector for connect or disconnect operation.

7. Apparatus comprising:

a connector;

a security shield substantially surrounding said connector having an aperture; and means for gripping the connector through an aperture including:

a lever means having two elements movable in opposition, a first element having a protrusion disposed inwardly, said protrusion being adapted to be received by at least one of said apertures, and adapted to apply a force upon said connector through said aperture;

a second element for providing a force in opposition to said first element; and means for applying a force in radial opposition to said protrusion;

wherein said protrusion and said means for providing a force in radial opposition act in concert to allow a rotational torque to be applied to the connector.

8. The apparatus of claim 7, wherein said lever comprises a second-class lever wherein said elements are formed to reside in different planes on either side of the lever pivot.

9. The apparatus of claim 8, wherein said lever comprises an installation plier having two protrusions disposed in opposition, each protrusion residing on a different lever element.

* * * * *